US005878605A

United States Patent [19]

Renz

[11] Patent Number: 5,878,605

[45] Date of Patent: Mar. 9, 1999

[54] LOCK, IN PARTICULAR MORTISE LOCK

[75] Inventor: Walter Renz, Ditzingen, Germany

[73] Assignee: Gretsch-Unitas GmbH Baubeschlage, Ditzingen, Germany

[21] Appl. No.: 858,265

[22] Filed: May 19, 1997

[30] Foreign Application Priority Data

May 17, 1996 [DE] Germany ..... 296 08 862.5

[51] Int. Cl.[6] ..... E05B 59/00

[52] U.S. Cl. ..... 70/107; 292/40

[58] Field of Search ..... 70/107, 108, 110, 70/111, 143, 149, 150; 292/34, 36, 40, 165, 39, 336.3, 336.5

[56] References Cited

U.S. PATENT DOCUMENTS 4,583,382 4/1986 Hull ..... 70/107
5,027,625 7/1991 Krachten ..... 70/107
5,083,448 1/1992 Karkkainen et al. ..... 70/107 X
5,265,920 11/1993 Kaup et al. ..... 70/107 X
5,469,723 11/1995 Litwin et al. ..... 70/107

*Primary Examiner*—Suzanne Dino Barrett
*Attorney, Agent, or Firm*—Jones, Tullar & Cooper, P.C.

[57] ABSTRACT

A lock for a door has a housing with an opening, a latch bolt and a further latch bolt both mounted to the housing for parallel displacement relative to the housing. A latch follower formed as part of a latch is connected to the latch bolt as is a changer, with the parallel displacement occurring due to the action of one of the latch follower via the latch and the changer via a key. A lock cylinder is situated in the housing opening. Two drive rods and associated control plates are provided along and a changer lever hinged to one of the control plates and connected to the lock cylinder. The lock cylinder can drive the changer via the changer lever and its hinged control plate. One side of the lock has, therefore, two drive rods.

10 Claims, 3 Drawing Sheets

LOCK, IN PARTICULAR MORTISE LOCK

FIELD OF THE INVENTION

The present invention relates to a lock, and in particular to a mortise lock for an exterior door, with a bolt and a latch bolt, which are situated in a lock housing and are parallel displaceable. The bolt can be actuated by means of a key, and the latch bolt can be selectively actuated by means of a latch with a follower or via a changer by means of the key. An opening for a lock cylinder is provided, wherein the changer can be driven by the bit of the lock cylinder.

BACKGROUND OF THE INVENTION

Locks of this type are used in exterior doors or apartment entry doors, wherein in the most used embodiment they are inserted as mortise locks into a lock receptacle of the door leaf and are held in the door leaf by means of a plate or the like on the front side. After attaching this mortise lock to the door, the door latch or latches and a lock cylinder are also installed. In the case of an exterior door, a door latch is normally only located on the inside, while a so-called knob, i.e. a non-actuatable handle is installed opposite it on the outside. The latch bolt can be retracted with the aid of the rotatable door latch. If the bolt is in its unlocked position, the door can be opened when the latch bolt is also retracted If no door latch has been attached on the outside, the door can only be opened from the outside with the aid of a key, by means of which the latch bolt can also be retracted. Furthermore, the bolt can be locked as well as unlocked with the aid of key from the outside as well as from the inside.

Locks are also known which are not only locked with respect to the solid frame in the area of the lock or the case of the lock, but also above and/or below the actual lock or the case of the lock, with the aid of additional locking devices. These locking devices provided in additional lock cases must be capable of being actuated simultaneously with the bolt, i.e. brought into an effective position or returned from this position into an ineffective position. Locks are furthermore known wherein the bolt can be brought into an effective position or out of it into a release position by means of a rotatable door latch, wherein of course the latch is also used here for actuating the latch bolt. Locks of this type are available both with and without additional locking devices, at least along the lock side of the door.

An additional lock case is known from German Patent Publication DE 35 03 466 A1, which can be driven by the main lock via a drive rod. This main lock can be embodied in accordance with European Patent Publication EP 0 575 701 A1, for example. In a locking device of this type the bolt is locked and unlocked by means of the lock cylinder. However, it has been shown to be disadvantageous that when opening the door, for example by actuating the door latch, not only the latch bolt but also the bolt of the additional lock case is actuated and displaced into the unlocked position, so that the door can be opened. It is therefore not possible to prevent premature opening of the door, for example by small children, so that uninvited persons have direct access.

OBJECT AND SUMMARY OF THE INVENTION

It is therefore an object of the present invention to further develop a locking device of the type mentioned at the outset in such a way that, even when opening the door by means of actuating the main lock case, a certain security against complete opening is still assured.

This object is attained in accordance with the present invention in a lock of the type mentioned at the outset in that in addition to the changer a changer lever is provided, that the changer lever is hinged to a second control plate and that the control plate is connected with a second drive rod, for example for a blocking pivot-shackle lock.

With the lock in accordance with the present invention it is possible to provide a blocking pivot-shackle lock, for example, which is actuated by means of a second drive rod, in addition to the additional lock cases. This second drive rod is triggered by a second control plate provided in the main lock. This second control plate is itself actuated by a changer lever connected with the changer. The additional lock cases and the blocking pivot-shackle lock are actuated in this way independently of each other by means of two drive rods. The additional lock cases can be triggered in this manner in such a way that they open together with the main lock, whereas the blocking pivot-shackle lock continues to remain in its blocking position, i.e. the blocking bolt remains in its locked position. This bolt is only released by the separate triggering of the second drive rod or of the blocking bolt by means of its turning knob, so that the door can be completely opened.

The changer as well as the changer lever can be triggered by means of the control cam.

Although the door can be slightly opened by means of the locking device in accordance with the present invention, complete pivoting in the open position is prevented. Accidental complete opening or unlocking of the door is prevented in this way.

In a further development it is provided that the changer lever is connected with the changer, in particular coupled with it via a pin-elongated hole connection. This pin-elongated hole connection permits relative movements between the changer lever and the changer, so that the actuation of the one need not directly cause the actuation of the other.

In accordance with a preferred exemplary embodiment, the changer lever is provided with an elongated hole, which is engaged by a pin of the changer. In the rest position of the lock the pin rests against one end of the elongated hole. If therefore the changer lever is moved in one direction, the changer is taken along via the pin resting against it. But if the changer is moved in the same direction, the pin runs free in the elongated hole without the changer lever being actuated.

A preferred exemplary embodiment provides that the changer lever has a control edge, on which a control cam acts by means of a gear, in particular a planetary gear, which can be actuated by means of the lock cylinder. The changer lever is therefore displaced in the lock via this planetary gear, which is being actuated by turning a key, and the second drive rod is moved by this. In addition, the changer is actuated by means of the changer lever, so that the latch bolt is retracted by means of it. Thus the door can be opened from the outside by means of a key, wherein all locks are moved into their open position.

The pin-elongated hole connection of the changer lever and the changer are selected to be such that the changer is driven by the actuation of the changer lever while, when actuating the changer by means of the latch follower, the changer lever is uncoupled. Therefore the unlocking of the bolt of the blocking pivot-shackle lock by means of the latch is impossible.

In a known manner the changer lever is guided in a first control plate via a connecting link and can be deflected out of the range of action of a planetary gear. In this way the changer lever is actuated by the planetary gear only when the latch bolt is retracted, but not when the bolt is pulled back.

It is considered to be advantageous that the second control plate is seated in the lock displaceable in the direction of the second drive rod. The second control plate extends parallel with the first control plate and has only the function of driving the second drive rod.

Further advantages, characteristics and details ensue from the following description, in which a particularly preferred exemplary embodiment is represented in detail, making reference to the drawings.

DETAILED DESCRIPTION OF THE PREFERRED EMBODIMENT

Figure 1:
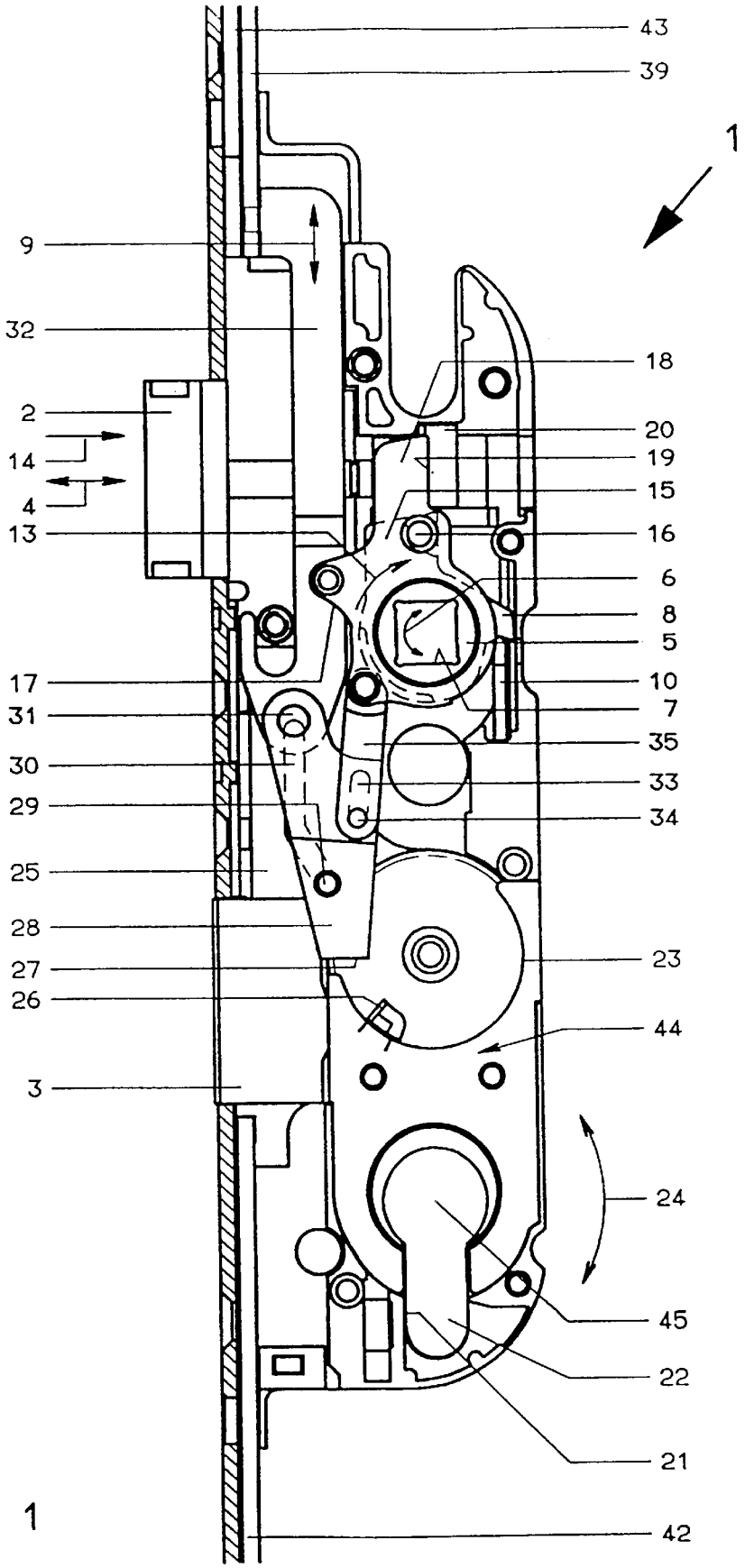
FIG. 1 shows a top view of a mortise lock in accordance with the present invention in the rest position and with the cover removed.

A main or lock housing, identified by 1 as a whole, is represented in the top view of FIG. 1, which is closed on the side facing the viewer by means of a cover, which has been removed and is therefore not represented in the drawings. A latch bolt 2 and a further bolt 3 are displaceable in the direction of the two-headed arrow 4 in the housing interior. In addition, a latch follower 5 is seated, rotatable in the direction of the two-headed arrow 6, in the lock housing 1. The lock follower 5 has an opening 7, in particular an opening with a square hole, to receive a square pin of a latch or other actuating element for the latch bolt 2. A radially protruding shoulder 8 of the latch follower 5 rests against the upper end of a displaceable intermediate piece 10, whose lower end is assigned to the upper end of a restoring spring (not shown). This is a helical compression spring, whose upper end is supported in a spring housing. If the latch 5 rotated in the direction of the arrow 13, it causes, on the one hand, a compression of the restoring spring, and on the other hand a retraction of the latch bolt 2 in the direction of the arrow 14. This is accomplished in that a further radially protruding shoulder 15 of the latch follower 5 is or can be placed against a pin-shaped projection 16 of a control follower disk 17, which is rotatably seated on the latch follower 5. For example, the end 18 of the control follower disk 17, pointed upward in FIG. 1, rests against a shoulder 19 of the inner end of the latch bolt 2 or the latch bolt tail 20.

A lock cylinder 22 of a known type, for example a profile cylinder, is inserted into an opening 21 on the bottom of the lock housing 1 and of the lock cover, not shown. This lock cylinder 22 is rotated with the aid of a key 36, inserted into the lock cylinder 22, in the direction of the two-headed arrow 24 around the geometric axis 45 and, via an interposed gear, in particular a planetary gear 44, causing the rotation of a gear wheel 23 and by this the extension or the retraction of the bolt 3. In this embodiment, the bit, not represented, of the lock cylinder 22 drives a split gear ring in a known manner. Its rotary movement is transmitted via two intermediate wheels to the gear wheel 23. In a known manner this; drives a first control plate 25 (further control plate), by which first drive rods 42 and 43 are driven upward or downward.

On its front, facing the viewer, the gear wheel 23 has a control cam 26 which in the course of the rotation of the gear wheel 23 drives a control edge 27 of a changer lever 28. This changer lever 28 is guided by means of a pin 29 in a connecting link 30 provided in the first control plate 25 and is hingedly fastened by means of a pin 31 to a second control plate 32. This second control plate 32 is seated, displaceable in the direction of the two-headed arrow 9, in the lock housing 1.

An elongated hole 33 is also provided on the changer lever 28, which is engaged by a pin 34 of a guide rod 35, which is pivotably connected with the control follower disk 17.

Figure 2:
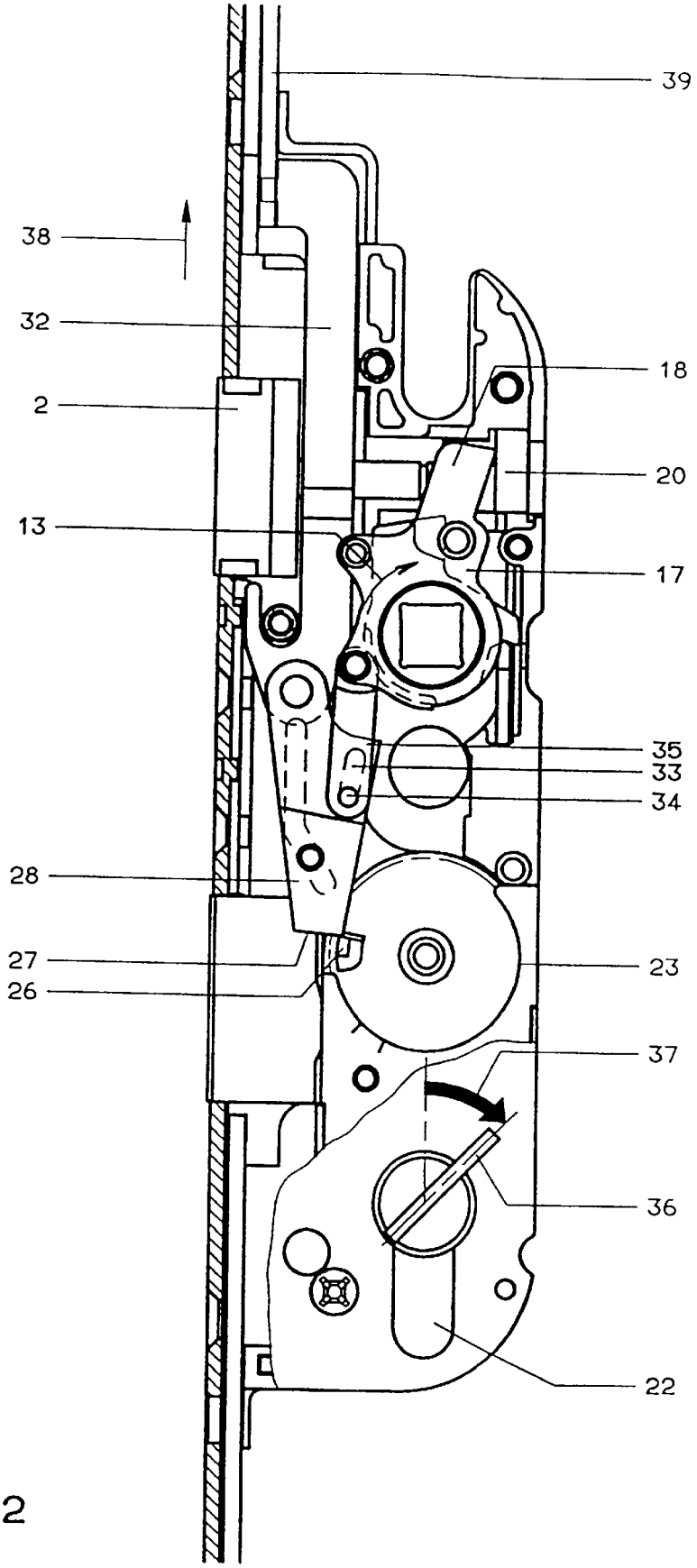
FIG. 2 a top view in accordance with FIG. 1, with the lock cylinder actuated.

If, as represented in FIG. 2, the lock cylinder 22 is actuated by means of a key 36 in the direction of the arrow 37, the control cam 26 acts on the control edge 27 of the changer lever 28 and displaces it upward, as a result of which the second control plate 32 is displaced upward in the direction of the arrow 38. A second drive rod 39 is fastened on this second control plate 32 and is driven by the second control plate 32. A blocking pivot-shackle lock is driven, in particular unlocked, by this second drive rod 39. Thus, this unlocking takes place when the lock cylinder 22 is actuated by means of a key 36.

The above described displacement of the changer lever 28 by the control cam 26 of the gear wheel 23 in addition causes a displacement of the guide rod 35, whose pin 34 rests against the end of the elongated hole 33. The displacement of the guide rod 35, which is hingedly fastened on the control follower disk 17, causes the turning of the control follower disk 17 in the direction of the arrow 13, as a result of which, as also described above, the latch bolt 2 is retracted by the end 18, which rests against the latch bolt tail 20. The door can then be opened.

Figure 3:
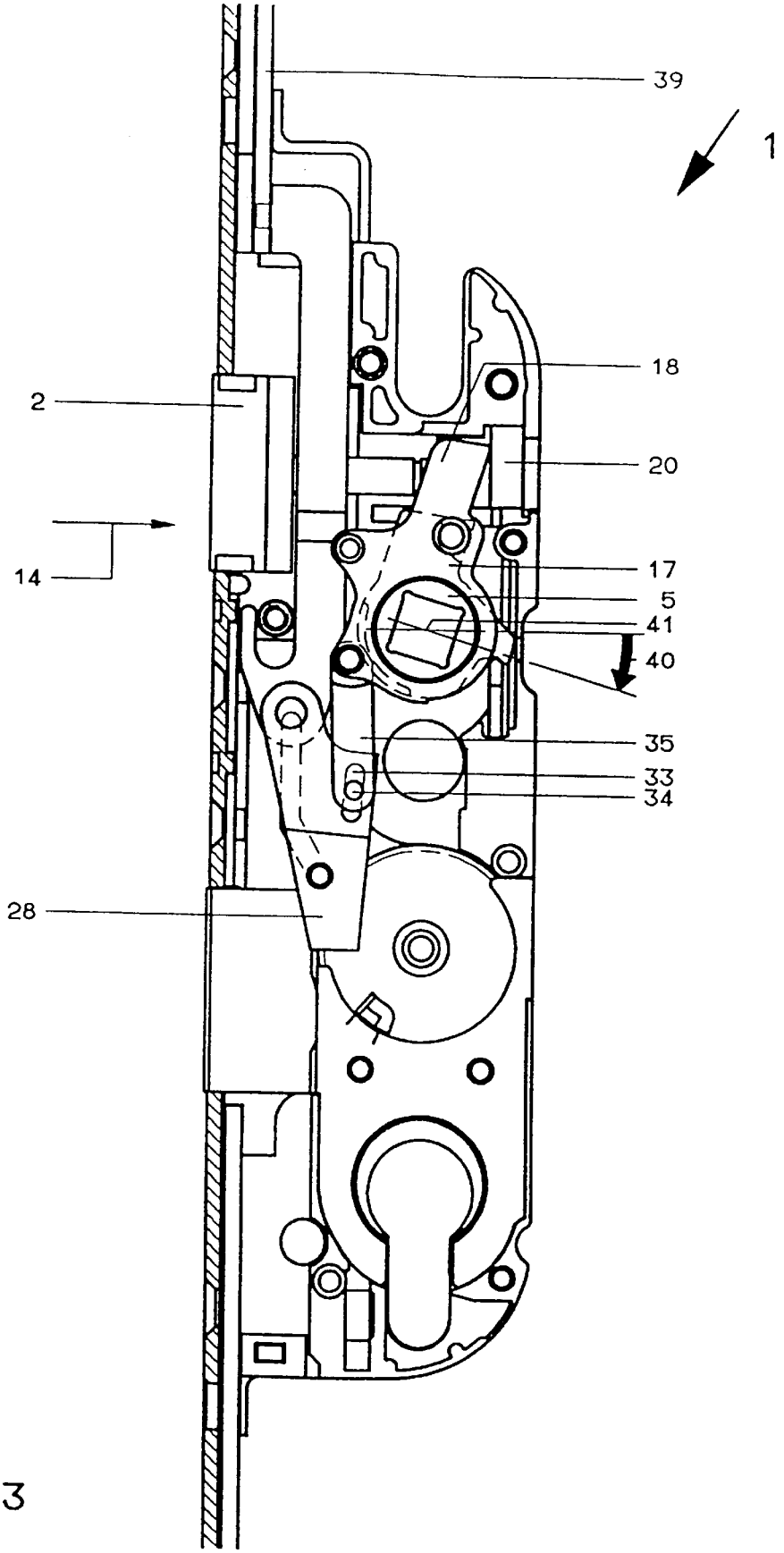
FIG. 3 is top view in accordance with FIG. 1, with the latch follower actuated.

In FIG. 3 the latch follower 5 is turned around the geometric axis 41 in the direction of the arrow 40 by the actuation of a latch, not shown. This causes the turning of the control follower disk 17 in the same direction, i.e. in a clockwise direction, as a result of which the latch bolt 2 is retracted in the direction of the arrow 14 by the end 18 resting against the latch bolt tail 20. Furthermore, the guide rod 35 is displaced, since it is hingedly fastened to the control follower disk 17. In the process, the pin 34 in the elongated hole 33 is displaced. The changer lever 28 is not taken along by the guide rod 35, because the pin 34 is uncoupled by the changer lever 28 through the elongated hole 33. Therefore the changer lever 28 remains in its rest position represented in FIG. 1 and FIG. 2.

If the lock 1 is therefore actuated by means of a latch, only the latch bolt 2 is retracted in the direction of the arrow 14, but not the changer lever 28, nor is the second drive rod 39 actuated by it. Therefore a blocking pivot-shackle lock connected with the second drive rod 39 is also not actuated, so that the door cannot be completely opened, but only as far as the blocking pivot-shackle lock allows it.

What is claimed is:

1. A lock for a door, comprising:

a housing including an opening;

a latch bolt and a further bolt both mounted to said housing for parallel displacement relative to said housing, said further bolt being actuated for [its] said parallel displacement by a key;

a latch follower formed as part of a latch and connected to said latch bolt;

changer means connected to said latch bolt, the parallel displacement of said latch bolt occurring due to the action of one of said latch follower by the latch and said changer means by the key;

a lock cylinder situated in said opening;

a first drive rod located on each side of said latch bolt and said further bolt;

a first control plate connected to said first drive rod on each of said sides;

a changer lever hinged to said first control plate and connected to said lock cylinder; a second drive rod located on the side of one of said latch bolt and said further bolt; and a second control plate connected to said second drive rod and said changer lever, wherein said changer means can be driven by said lock cylinder by said changer lever and said first control plate.

2. The lock as defined in claim 1, wherein said changer means includes a guide rod and said changer lever is connected to said guide rod.

3. The lock as defined in claim 2, wherein said changer lever includes an elongated hole engaged by a pin mounted to said guide rod.

4. The lock as defined in claim 3, wherein the engagement of the pin with one end of said elongated hole defines a rest position of the lock.

5. The lock as defined in claim 1, further comprising:

gear means connected to said lock cylinder, wherein:

said control lever his a control edge and said gear means has a control cam; and said control lever is engaged by said control cam for actuation initiated by said lock cylinder.

6. The lock as defined in claim 5, wherein said gear means includes a planetary gear.

7. The lock as defined in claim 1, wherein actuation of said changer lever produces actuation of said changer means.

8. The lock as defined in claim 1, further comprising:

gear means connected to said lock cylinder; and a connecting link connected to said changer lever for guiding said changer lever in said second control plate out of the range of action of said gear means.

9. The lock as defined in claim 1, wherein said first control plate is seated in said housing displaceable in the direction of said first drive rod.

10. The lock as defined in claim 2, wherein said changer means further includes a control follower disk hingedly connected to said guide rod, and wherein said control follower disk is rotatably seated on said latch follower and drivably connected to said latch bolt.

* * * * *